US011807449B2

(12) United States Patent
Parker et al.

(10) Patent No.: US 11,807,449 B2
(45) Date of Patent: Nov. 7, 2023

(54) WASTE DISPOSAL SYSTEM HAVING GUIDE FEATURES

(71) Applicant: Angelcare USA, LLC, Newark, DE (US)

(72) Inventors: Dylan Parker, Phoenix, MD (US); Alexander Chenvainu, Mahwah, NJ (US)

(73) Assignee: ANGELCARE USA, LLC, Newark, DE (US)

( * ) Notice: Subject to any disclaimer, the term of this patent is extended or adjusted under 35 U.S.C. 154(b) by 0 days.

(21) Appl. No.: 15/643,785

(22) Filed: Jul. 7, 2017

(65) Prior Publication Data

US 2018/0155123 A1 Jun. 7, 2018

Related U.S. Application Data

(60) Provisional application No. 62/359,734, filed on Jul. 8, 2016.

(51) Int. Cl.
*B65B 67/12* (2006.01)
*B65F 1/06* (2006.01)
(Continued)

(52) U.S. Cl.
CPC ..... *B65F 1/06* (2013.01); *B65F 1/0006* (2013.01); *B65F 1/068* (2013.01); *B65F 1/1415* (2013.01);
(Continued)

(58) Field of Classification Search
CPC ..... B65F 1/067; B65F 1/065; B65F 1/062; B65F 1/06; B65F 1/068; B65F 1/1415; B65F 1/0006; B65F 1/163; B65F 1/10; B65F 2210/1675; B65F 2240/132; B65F 1/00; B65F 1/141; B65D 85/08; B65D 85/04; B65D 25/36; B65D 1/38; B65D 11/14; B65D 9/15; B65H 49/02;
(Continued)

(56) References Cited

U.S. PATENT DOCUMENTS 2,989,828 A * 6/1961 Warp ..... A01G 9/02 53/390
4,934,529 A * 6/1990 Richards ..... B65B 9/15 206/303
(Continued)

FOREIGN PATENT DOCUMENTS

CA 2366384 A1 * 6/2003 ..... B65B 67/1277
CA 2387183 A1 * 6/2003 ..... B65B 67/1277
(Continued)

*Primary Examiner* — Allan D Stevens
(74) *Attorney, Agent, or Firm* — Norton Rose Fulbright US LLP

(57) ABSTRACT

A waste disposal system has a waste disposal device and cassette having a length of flexible film. The cassette has a lower surface and a guide feature enabling the cassette to rotate within the upper housing of the pail, maintain a substantially stationary position within the upper housing of the pail, or combinations thereof. The waste disposal device has a guide member that engages the guide feature of the cassette. The waste disposal device has a cassette housing and a sealing mechanism. One of the housing and sealing mechanism, and the cassette, rotate with respect to the other, either directly or indirectly.

12 Claims, 10 Drawing Sheets

(51) Int. Cl.
*B65F 1/16* (2006.01)
*B65F 1/14* (2006.01)
*B65F 1/00* (2006.01)
*B65F 1/10* (2006.01)

(52) U.S. Cl.
CPC ..... *B65F 1/163* (2013.01); *B65F 1/10* (2013.01); *B65F 2210/1675* (2013.01); *B65F 2240/132* (2013.01)

(58) Field of Classification Search
CPC ..... B65B 43/42; B65B 63/02; B65B 67/12; B65B 67/1277; B65B 67/1266; B65B 9/18; A47K 11/026
USPC ..... 220/495.07, 495.06, 908.1, 908, 908.3, 220/324, 315, 359.4, 361, 9.1, 9.2, 9.3, 220/9.4, 495.08; 206/303, 554, 495.01, 206/495.06, 495.08; D34/1, 7–10
See application file for complete search history.

(56) References Cited

U.S. PATENT DOCUMENTS 5,897,084 A * 4/1999 Judge ..... B65B 67/12 248/95
8,959,880 B2 * 2/2015 Morand ..... B65B 67/1222 206/303
9,085,404 B2 * 7/2015 Dunn ..... B65F 1/062
9,802,756 B2 * 10/2017 Dunn ..... B65F 1/062
2007/0045326 A1 * 3/2007 Tramontina ..... B65F 1/0006 220/495.11
2007/0205191 A1 * 9/2007 Pyle ..... B65D 1/34 220/23.91
2008/0272140 A1 * 11/2008 Mowers ..... B65F 1/062 221/69
2010/0005759 A1 * 1/2010 Stravitz ..... B65B 67/1277 53/118
2012/0091295 A1 * 4/2012 Morand ..... B65F 1/062 248/99
2014/0110293 A1 * 4/2014 Dunn ..... B65F 1/062 206/389
2014/0208499 A1 * 7/2014 Livingston ..... A47K 11/026 4/484
2016/0060025 A1 * 3/2016 Dunn ..... B65F 1/0006 206/409
2016/0083182 A1 * 3/2016 Dunn ..... B65F 1/062 206/409
2016/0355333 A1 * 12/2016 Al Umayri ..... B65F 1/062
2018/0281653 A1 * 10/2018 Guilhem ..... B60N 3/08

FOREIGN PATENT DOCUMENTS

CA 2724805 A1 * 11/2009 ..... B65F 1/062
DE 2239880 A1 * 2/1974 ..... B65F 1/16
WO WO-2013028679 A1 * 2/2013 ..... A47K 11/02

* cited by examiner

WASTE DISPOSAL SYSTEM HAVING GUIDE FEATURES

CROSS-REFERENCE TO RELATED APPLICATIONS

This application claims priority to U.S. Provisional Patent Application Ser. No. 62/359,734, filed Jul. 8, 2016, the entirety of which is incorporated herein.

BACKGROUND OF THE PRESENT DISCLOSURE

Cassettes for providing a length of flexible tubing for use within a waste disposal pail, particularly waste pails used in conjunction with collecting and storing human and animal waste such as diapers, wipes, hygiene products, and pet waste are known. Many known waste disposal systems include those where a sealing structure and the cassette rotate with respect to each other, thereby creating a twist in flexible tubing and thus a seal. A seal can be accomplished by stabilizing the cassette and rotating either (a) the housing proximal to the cassette and/or (b) a sealing structure within the pail. A seal can also be accomplished by rotating the cassette. Known cassettes have features that either (a) permit rotation or (b) permit stabilization but fail to provide a single feature that can do both. Known cassettes are typically compatible with only one pail system.

A need exists for an improved rotation/stabilization system in waste disposal devices. A further need exists for increasing cassette compatibility for use amongst various systems with various odor control benefits. A cassette comprising guide features that can (a) permit rotation and/or (b) permit stabilization is desirous. A cassette comprising guide features that can permit use in multiple systems is further desirous.

SUMMARY OF THE PRESENT DISCLOSURE

A waste disposal system having a guide system is provided. The guide system has components on a cassette having a length of flexible film and a waste disposal device. The cassette has one or more guide features. The waste disposal device has one or more guide members. The guide feature(s) on the cassette engages and mates with the guide member(s) of the waste disposal device, cooperating as the guide system. The cassette has multiple configurations permitting the cassette to cooperate with one or more guide member(s), or said differently, can cooperate as a part of multiple guide systems. For instance, a cassette has a first end and a second end. The first end has guide features that are different from guide features on a second end such that the first end of the cassette mates with a first set of guide members and the second end of the cassette mates with a second set of guide members. The cassette can thusly mate with two or more different waste disposal devices employing different guide members.

In another embodiment, the cassette has an upper surface and a lower surface. One of such surfaces has guide features that enable the cassette to mate with multiple waste disposal devices employing different guide members. The cassette has guide features that enable the cartridge to be rotatable and/or stable, in connection with the waste disposal device. The cassette may have substantially flexible guide members and substantially rigid guide members such that, upon rotation of the cassette and/or the guide members in the pail, the cassette will either (a) remain stationary, (b) become stationary as the flexible members assist in stopping the cassette's rotation with the rotation of the guide members, or (c) the cassette will rotate. As described throughout the present disclosure, the one or more guide features and one or more guide members vary in shape, size, construction, location and configuration, and in number.

In another embodiment, the cassette has a first end having one or more receptors and a second end having one or more guide features. The one or more guide features on a first cassette and the one or more receptors on a second cassette are self-aligning in that they are shaped, sized, constructed, configured and positioned to, upon imperfect alignment, shift one cassette with respect to the other such that the two cassettes become aligned and are in a stack.

DETAILED DESCRIPTION OF THE PRESENT DISCLOSURE

Figure 1:
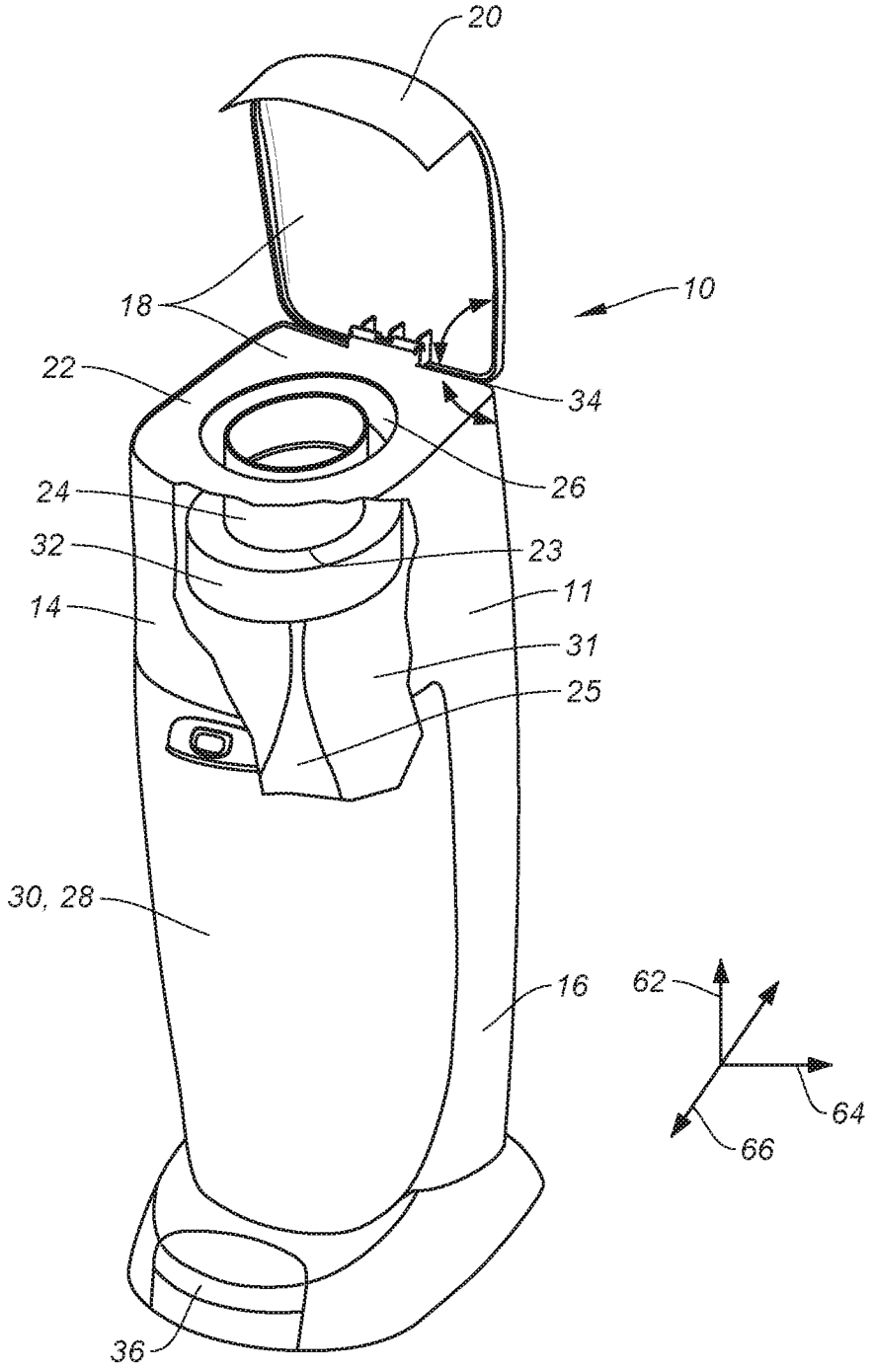
FIG. 1 is a diagrammatic perspective view of a waste disposal system embodiment with cutaway section according to the present disclosure.
Figure 2:
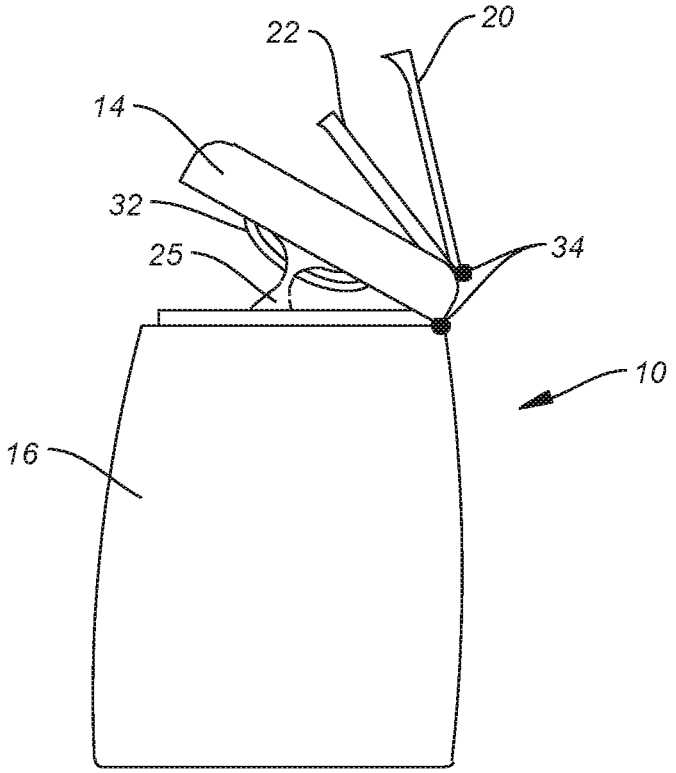
FIG. 2 is a diagrammatic perspective view of a waste disposal system embodiment according to the present disclosure.

A waste disposal system 10 is provided and employs a guide system 12. The waste disposal device 11 has an upper housing 14 having receiving portion 23 for cassette 24. In some embodiments, the upper housing 14 includes a dual lid system 18 wherein the outer lid 20 maintains a barrier between the inside of the waste disposal device 11 and the ambient environment, and the inner lid 22 assists in (a) securing the cassette 24 within the upper housing 14 of the waste disposal device 11, or (b) providing a funnel feature to assist waste entering into the waste disposal device 11. The dual lid system 18 is coaxial, or the outer lid 20 and inner lid 22 are on separate axes. In further embodiments, the outer lid 20 and/or inner lid 22 may also interact with the lower housing 16 of the waste disposal device 11 (i.e. where the upper housing 14 is slight in height and/or where the upper housing 14 is shaped such that a portion of the lower housing 16 directly interfaces with the outer lid 20 and/or inner lid 22). In some embodiments, the guide system 12 is located below the outer lid 20. In some embodiments, the guide system is located below the inner lid 22. In other embodiments, the guide system is located above the storage portion 31 of the waste disposal device 11. The waste disposal device 11 has a waste insertion opening 26 covered by a lid 18, 20, and/or 22. The waste disposal device 11 has a lower housing 16 for collecting and storing disposed waste. The lower housing 16 has a door 28 that provides access to the storage portion 31 of the waste disposal device 11. Optionally, the waste disposal device 11 has a removable and/or rotatable bin 30 for collecting stored waste and facilitating easy removal of the waste. The lower housing 16 and upper housing 14 are, in some embodiments, separated by a sealing mechanism 32. For clarity, the sealing mechanism 32 may be located within the upper housing 14 or the lower housing 16, or may define the physical separation between the two. In some embodiments, the sealing mechanism 32 twists flexible film 25 to create a seal. The sealing mechanism 32 can be rotated, or be fixed such that another portion of the waste disposal device 11 rotates. In some embodiments, the cassette 24 can be rotated with respect to the sealing mechanism 32. The upper housing 14 may be attachable to the lower housing 16 by a hinge 34 or other connection means (i.e., press fit, friction fit, interference fit, etc.). In some embodiments, the upper housing 14 is movable with respect to the lower housing 16 while maintaining a connection with the lower housing 14. A waste disposal device 11 may further comprise a user-activated mechanism such as a foot pedal 36 that enables remote movement of the outer lid 20, the sealing mechanism 32, and/or both. Such embodiments enable a user to engage the waste disposal system 10 with a single hand (via two steps in series) and/or a single hand and foot (via two steps in series). The waste disposal device 11 has a receiving portion 23 in physical or mechanical connection with the upper housing 14 and/or sealing mechanism 32 that engages the cassette 24, as described below.

Figure 3:
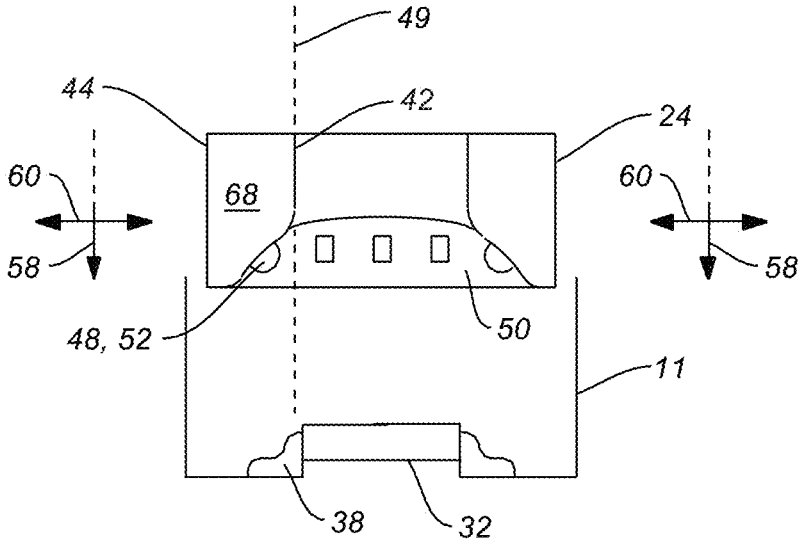
FIG. 3 is a diagrammatic partial view of an example of a cassette and a waste disposal device of the waste disposal system according to an embodiment of the present disclosure.

The cassette 24 has a body 27 defining an inner perimeter 42, which, in some embodiments, further defines an inner wall 113. The cassette 24 has a length of flexible film 25 that, in a use state, extends through the inner perimeter 42 (defining the insertion opening area 46) to permit the collection of waste to be inserted by a user. The cassette 24 has a lower surface 50. The cassette 24 has at least one guide feature 48 on the lower surface 50 of the cassette 24. In one embodiment, the guide feature 48 is at least one wall 52 with sufficient thickness to resist deflection upon engaging a mating guide member 38 in the waste disposal device 11. The wall 52 extends inwardly (e.g., towards a center of cassette 24 along axis 60, as shown in FIG. 3) towards the inner perimeter 42. In some embodiments, the wall 52 extends towards the inner perimeter 42 but does not delimit or reduce the size of the inner perimeter as shown by dashed line 49, thereby maximizing the insertion opening area 46. In some embodiments, the guide feature 48 comprises at least one wall 52 that is sufficiently flexible (as demonstrated by reference numeral 52*a*) to permit deflection. The guide feature 48 operates by mating with the guide member 38 permitting rotation. Upon sufficient rotation to create a seal, the guide member 38 deflects the guide feature (e.g., 48) and upon contacting substantially rigid guide feature (e.g., rigid wall 52*b*), the cassette 24 remains substantially stationary. The interaction between the guide feature 48 and guide member 38 can provide feedback (tactile, audible) to the user helping to assure the user that a seal has been created although the visual line of sight to the guide feature 48 and guide member 38 mating may be obstructed.

In some embodiments, the guide feature 48 comprises at least one sufficiently flexible wall 52*a* and at least one sufficiently rigid wall 52*b*. In further embodiments, the guide feature 48 includes at least one sufficiently flexible wall 52*a* proximal to the at least one sufficiently rigid wall 52*b*. In yet further embodiments, the guide feature 48 includes at least one sufficiently flexible wall 52*a* on either side and proximal to the at least one sufficiently rigid wall 52*b*. The guide feature 48 may be a plastic such as polyester, polyethylene, low density polyethylene (LDPE), linear low density polyethylene (LLDPE), high density polyethylene (HDPE), Acrylonitrile butadiene styrene (ABS), Kostrate, Ethylene-vinyl acetate (EVA), vinyl, may be a thermoplastic elastomer or a rubber material, or may be otherwise elastomeric, flexible, stretchable, extensible, and combinations thereof. The guide feature 48 may have a distal end 108 that has a cam surface or is arcuate. One skilled in the art understands these materials can be utilized for one or more components of the cassette and/or waste disposal device.

In some embodiments, the guide feature 48 comprises at least two sufficiently rigid walls 52*b* that mitigate against applied forces such that the cassette 24 is in a more stable state (i.e. the cassette 24 does not substantially rotate). These at least two rigid walls 52*b* can be proximal to allow only slight, if any, movement by the cassette 24 with respect to the waste disposal device 11 and thus keep the cassette 24 in a stable state. These at least two rigid walls 52*b* can be other than proximal such that each rigid wall interacts with a separate guide member 38 and thus permits (1) a controlled amount of movement or rotation between each rigid wall 52*b* and each guide member 38, or (2) mitigates against rotation and thus keep the cassette 24 in a more stable state.

In some embodiments, the guide feature 48 is shaped like a fin 53 and thus projects downwardly (e.g., 58) from the lower surface 50. The fin 53 has a body portion 53*a* and a tip portion 53*b* that is narrower than the body portion 53*a*. A slice of the fin 53 along a vertical axis is generally triangular, a blunter, arcuately shaped structure, or combinations thereof. At least two cross-sectional slices, as shown by dashed lines 54*a* and 54*b*, of the fin 53 beginning towards the body portion 53*a* and going towards the tip portion 53*b* reveals a fin 53 shape that is tapered, prismatic, pyramidal, rectangular, trapezoidal, triangular, conical, arcuate, or combinations thereof.

In some embodiments, the guide feature 48 comprises at least one wall 52 and/or fin 53. In some embodiments, the guide feature 48 comprises less than fifty walls 52 and/or fins 53. In some embodiments, there are between about two and thirty-six guide features 48. In other embodiments, there are between about six and twenty-four guide features 48. In yet other embodiments, there are at least two guide features 48, at least four guide features 48, at least eight guide features 48, or at least 12 guide features 48. In some embodiments, there is a similar and/or corresponding number of guide members 38, as described throughout the present disclosure.

In some embodiments, the lower surface 50 has a two dimensional topography. In some embodiments, the lower surface 50 has a three-dimensional topography. The guide feature 48 extends downwardly 58 and/or inwardly along axis 60.

In some embodiments, the lower surface 50 is at least partially oblique with respect to an axis 64 that is parallel to the ground on which the waste disposal system 10 rests. The guide feature 48 extends downwardly 58 and/or inwardly along axis 60 from the lower surface 50.

As exemplified in FIGS. 6A-6L, the cross section of the lower surface 50 may be linear, or arcuate, may be undulating, stepped, perfect steps, or any other geometric shape or combinations thereof. The lower surface 50 may be substantially flat, curved, undulating, stepped towards the inner perimeter 42 or an outer perimeter 44. In embodiments having a stepped geometry, the guide feature may be one or more of the steps, and/or have perfect steps (i.e. congruent in rise, run and length).

In some embodiments, the cassette 24 has a body 27 that provides a hollow volume 68 for the storage and dispensation of flexible film 25.

In some embodiments, the guide feature 48 is hollow such that the hollow portion 68*a* of the guide feature 48 communicates with the hollow volume 68 of the cassette body 27. The one or more guide features 48 have sufficient dimensions to permit storage of flexible film 25.

In such embodiments, the guide feature 48 may act to (a) increase volume by increasing the height, depth, and/or width of the lower portion 69*b* of the cassette 24, (b) substantially decrease volume (preferable in single-use cassettes embodiments, for use with compact pail systems, for reducing the amount of material required for production and/or the amount of flexible film wasted by improper disposal usage, etc. . . . ), or (c) to the extent the lower portion 69*b* of the cassette is a unique geometry that reduces the hollow volume 68 of the cassette 24 in comparison to known cassette geometry (i.e. a substantially cylindrical or annular shape), the guide feature 48 may increase the hollow volume 68 of the cassette 24 such that it is substantially similar to the volume of the known cassette geometry.

The guide feature 48 can also function as a mating feature with an upper portion 69*a* of a cassette 24. In some embodiments, the upper portion 69*a* of the cassette 24 has a receptor 56. The receptor 56 is a structure or gap suitably sized to receive at least a portion of the guide feature 48. The receptor 56 can be a protrusion (i.e. a peak 76*a*) or a recess (i.e. a valley 76*b*). The receptor 56 and guide feature 48 interact to assist in correcting alignment amongst the guide feature 48 of a first cassette 24*a* and the receptor of a second cassette 24*b*. Said another way, upon imperfectly placing the guide feature 48 of a first cassette 24*a* on the receptor 56 of a second cassette 24*b*, the receptor 56 and guide feature 48, in concert, direct movement between the first cassette 24*a* and second cassette 24*b* such that the first cassette 24*a* settles into improved alignment with respect to the second cassette 24*b*. The guide feature 48 and receptor 56 are duly sized and configured to permit movement in at least two axes, and in some embodiments, along three axes. The relative movement permitted in at least two axes allows for shifting during packaging, transport and storage such that general alignment is maintained despite variable external conditions. In some preferred embodiments, the guide feature(s) 48 and the receptor(s) 56 are arcuate. In some such embodiments, the guide feature 48 is undulating and smooth (i.e. without edges, sharp features and/or points), where the undulations define peaks 76*a* and valleys 76*b*. The peaks 76*a* and valleys 76*b* are sloped and positioned proximate to each other such that plateaued surfaces are avoided. In some such embodiments, the report is undulating and smooth (i.e. without edges, sharp features and/or points), where the undulations define peaks 76*a* and valleys 76*b*. The peaks 76*a* and valleys 76*b* are sloped and positioned proximate to each other such that plateaued surfaces (including surfaces that are slightly curved with slight slope) are avoided. In any such configurations, plateaued surfaces on guide feature(s) 48 and receptor(s) 56 are avoided.

In further embodiments, the peaks 76*a* and valleys 76*b* of the guide feature(s) 48 and/or receptor(s) 56 have a larger widthwise and/or heightwise dimension about the outer perimeter 44 of the cassette 24, and a smaller widthwise and/or heightwise dimension about the inner perimeter 42 of the cassette 24. This assists in creating an upper surface 51 of the cassette 24 having a funnel-like shape 72 to assist in directing waste material through the central opening 46 of the cassette 24 and into the film 25. In some such embodiments, the widthwise and heightwise variance in the peaks 76*a* and valleys 76*b* approach each other such that the inner perimeter 42 is substantially planar.

In yet other embodiments, the guide feature(s) 48 and/or receptor(s) 56 have an undulating configuration such that the undulations get progressively smaller as they approach the inner perimeter 42. The guide feature(s) 48 and/or receptor(s) 56 have an undulating configuration such that the undulations get progressively larger as they approach the outer perimeter 44. In one embodiment, the receptor 56 includes a valley 76*b* proximal the inner perimeter 42 such that a guide feature 48 having a peak 76*a* will matingly engage and assist with two cassettes 24 self-orienting into a stack.

In certain embodiments where the film 25 is stored within a hollow volume 68 inside the cassette 24, the cassette 24 has at least one port 84. The port 84 can be positioned proximal the inner perimeter 42, proximal the outer perimeter 44, and/or towards a middle portion 78 between the inner perimeter 42 and the outer perimeter 44.

In embodiments where the port 84 is located proximal the inner perimeter 42, the port 84 may coincide with an undulation that is larger than other undulations such that the film 25 is metered (i.e. the film 25 is controlled such that it does not dispense too quickly; without such undulation there would be no other structure on the cassette 24 to prevent the film 25 from being pulled too quickly out of the hollow volume 68). The undulation may be bulbous (e.g., 74) to create a mini-funnel effect, thereby assisting waste to enter the film 25 in the central opening 46. The port 84 proximal the inner perimeter 42 could be at the valley 76*b* of such undulation such that the film must travel over the peak 76*a* of the undulation. The port 84 proximal the inner perimeter 42 could be at the peak 76*a* of such undulation such that the film 25 must be pulled upward through the undulation such that the undulation forms a neck and thus controls dispensation of film 25.

In embodiments where the port 84 is located in the middle portion 78, there may be a single, steep undulation such that the port 84 is outward of the middle portion 78 (i.e. at least proximal the outer perimeter 44) that will not be covered by the film 25 will be small and thus less likely to be soiled upon disposal of waste into the film 25.

In some embodiments, a cassette 24 has a first end 80 and a second end 82. In some embodiments, the first end 80 corresponds to an upper surface 51, and the second end 82 corresponds to the lower surface 50. In some embodiments, the first end 80 corresponds to the lower surface 50, and the second end 82 corresponds to the upper surface 51. The first end 80 is generally opposite the second end 82. The first end 80 has a first configuration including one or more guide features 48 that mate with the first guide member(s) 38*a* (and optionally, a first receptor(s)) 56*a*). The second end 82 has a second configuration including one or more guide features 48 that mate with the second guide member(s) 38*b* (and optionally, second receptor(s) 56*b*). In these embodiments, the first receptor(s) 56*a* is at least similar to the first guide features(s) 48*a*, the second guide feature(s) 48*b*, and/or the second receptor(s) 56*b*, such that one or more cassettes 24 are stackable as discussed throughout the present disclosure. At least one of the first end 80 and the second end 82 have a port 84 to enable the dispensation of film 25 out of the port 84. In some embodiments, the port 84 is revealed after mechanical manipulation of the end (i.e. removing a tear strip 86, disconnecting two portions of the cassette body 24 to reveal a port 84, etc. . . . ). In embodiments having one port 84, a length of flexible film 25 is dispensed from the port 84 and downward along direction 58 through the opening 46. In further embodiments, the film 25 is also sized such that the diameter of the flexible film 25 is greater than the outer perimeter 44 of the cassette 24. In these embodiments, the cassette 24 can be installed such that the first end 80 or the second end 82 is downward and mates with the waste disposal device 11 (having mating guide member(s) 38) and the film 25 loops outward and over the outer perimeter 44 of the cassette 24 and thereafter downward along direction 58 through opening 46. This configuration is advantageous as it enables the cassette 24 to be oriented in multiple configurations, is compatible with at least two different types of receptors 56, and provides a cassette 24 where the upward facing end is covered by the film 25, thereby mitigating the soiling of the cassette 24 itself (and thus mitigating odor). The port(s) 84 can be located as described throughout the present disclosure.

In some embodiments, the cassette 24 has two ports 84, a first port 84*a* on a first end and a second port 84*b* on a second end 82. In this embodiment, the film 25 has a diameter exceeding the inner perimeter 42 of the cassette 24, as the film 25 can be dispensed from both sides of the cassette 24 thus not requiring (albeit permitting) the film 25 to loop outward and over the outer perimeter 44 of the cassette 24.

In some embodiments, the first end 80 having a first guide feature 48*a* is compatible with a first guide member 38*a* and a second guide member 38*b*. In some embodiments, a second end 82 having a second guide feature 48*b* is compatible with a first guide member 38*a* and a second guide member 38*b*.

In some embodiments, the structure of the cassette 24 comprises multiple materials (as described throughout the present disclosure) or the absence of material. The cassette 24, for example, is skeletonized 88 to reduce the use of certain material(s). The cassette 24 can be completely skeletonized 88 (i.e. holistic skeletonization), or portions of the cassette 24 can be skeletonized 88 (i.e. local skeletonization). The cassette 24 of this embodiment, for instance, would reduce the use of polypropylene or other resins and thus impart flexibility in the cassette 24 structure such that it could be modified to fit a variety of guide members 38. The skeletonized 88 cassette 24 would have enough bracing structures 90 in at least one of vertical planes (i.e. along axis 62 and either of axis 64 or 66) and horizontal planes (i.e. along axes 64 and 66). In some embodiments, the bracing structures 90 can be shaped/positioned to be in both planes. In some embodiments, the bracing structures 90 are U-shaped and interact/support with film layer 70. To the extent the cassette 24 is configured to store flexible film 25 within a hollow volume 68 of the cassette 24, the flexible film 25 would assist in imparting structure to the cassette 24 by providing an outward force against the bracing structures 90.

In some embodiments, one or more portions of the cassette 24 can comprise a film layer 70 (i.e. a shrink wrap or overwrap). The film layer 70, in these embodiments, can replace rigid material commonly used in cassettes 24 to reduce cost and/or waste. For instance, the flexible film layer 70 can be overlaid onto at least portions of a skeletonized 88 cassette 24 to assist with containing flexible film 25 stored within the cassette 24, and/or to prevent contamination of the flexible film 25 stored therein.

The film layer 70 overlay can also be used to replace a portion of the cassette body 27 in a non-skeletonized cassette 24. For instance, the film layer 70 can be spot-welded, applied by adhesive, ultrasonics, shrink-wrapped, melted, and/or other methods and thus provide local coverage as opposed to substantially covering the entire periphery of the cassette 24.

In some embodiments, a skeletonized 88 cassette 24 having and overlay of film layer 70 is frangible to enable connection with one or more multiple guide members 38, where the guide members 38 may be similar or different in shape, structure, material, etc . . . . For instance, a first guide member 38*a* having a protruding end 38*c* that is sized to fit between two bracing structures 90*a*, 90*b* would rupture the film layer 70 covering the skeletonized 88 portion between the bracing structures 90*a*, 90*b* and thus connect the cassette 24 to the waste disposal device 11. The film layer 70, to assist in this connection, could be equipped with a perforation 92, slit(s) and/or hole(s) 94.

In some embodiments, the guide feature 48 is a door 96. The door 96 has at least one end 98 that is capable of becoming free or deflectable from the adjacent regions of the cassette 24. The door 96 can thusly be separated from the adjacent regions of the cassette 24 by one or more slits 94 one or more sides of the door 96. The door 96 can be hingedly connected 100 (by mechanical fasteners/connections or a living hinge) to at least one adjacent region of the cassette body 24. In some embodiments, a film layer 70 overlays the door 96 such that the door 96 remains closed until the film layer 70 is separated by a receptor. In some of these embodiments, a slit or hole 94 in the film layer 70 overlays a portion of the door 96 such that upon mating with the guide member 38, the door is opened without breaking film layer 70.

Figure 4B:
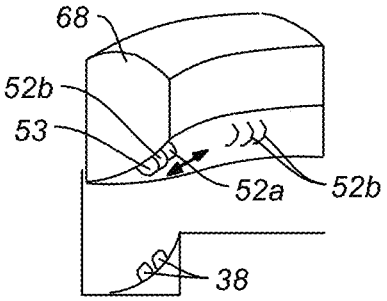
FIG. 4B is a diagrammatic section of a partial view of another example of a cassette and a waste disposal device of an embodiment of the waste disposal system according to the present disclosure.
Figure 4A:
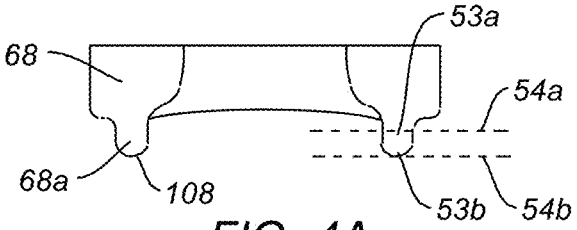
FIG. 4A is a diagrammatic partial view of another embodiment of a cassette according to the present disclosure.
Figure 4C:
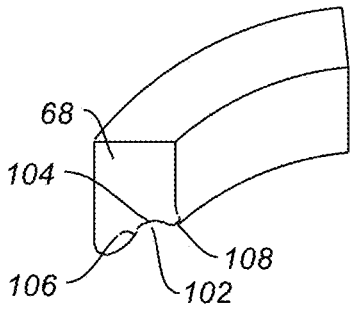
FIG. 4C is a diagrammatic partial view of another embodiment of a cassette according to the present disclosure.
Figure 4D:
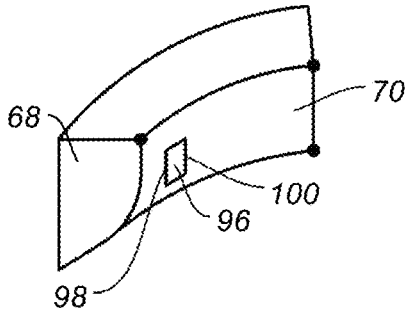
FIG. 4D is a diagrammatic partial view of another embodiment of a cassette according to the present disclosure.
Figure 5:
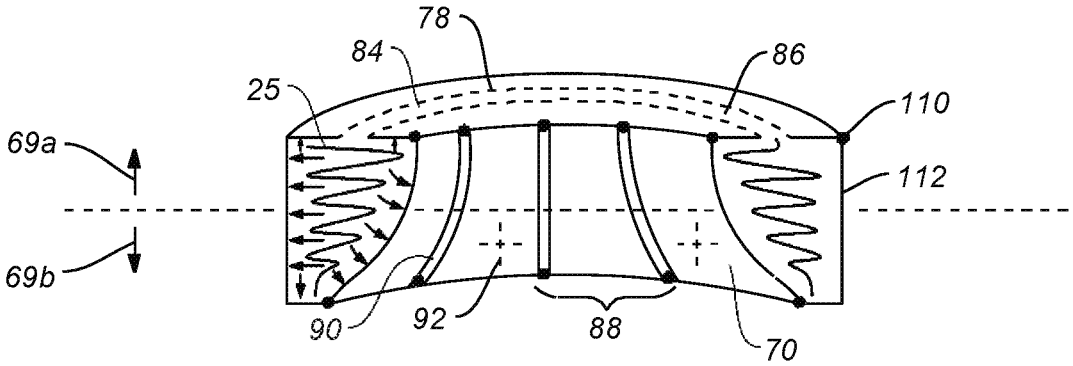
FIG. 5 is a diagrammatic sectional view of an example of a cassette according to an embodiment of the present disclosure.
Figure 6A:
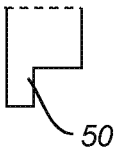
FIGS. 6A-6L are diagrammatic vertical partial sectional slice of various cassette embodiments according to the present disclosure.
Figure 6B:
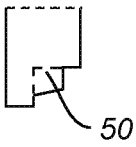
Figure 6C:
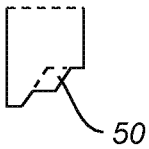
Figure 6D:
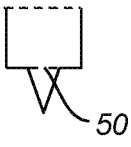
Figure 6E:
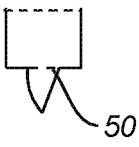
Figure 6F:
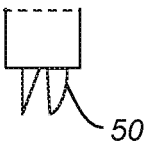
Figure 6G:
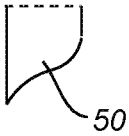
Figure 6H:
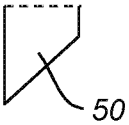
Figure 6I:
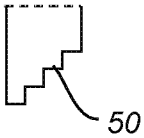
Figure 6J:
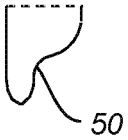
Figure 6K:
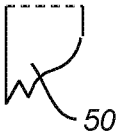
Figure 6L:
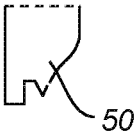
Figure 7:
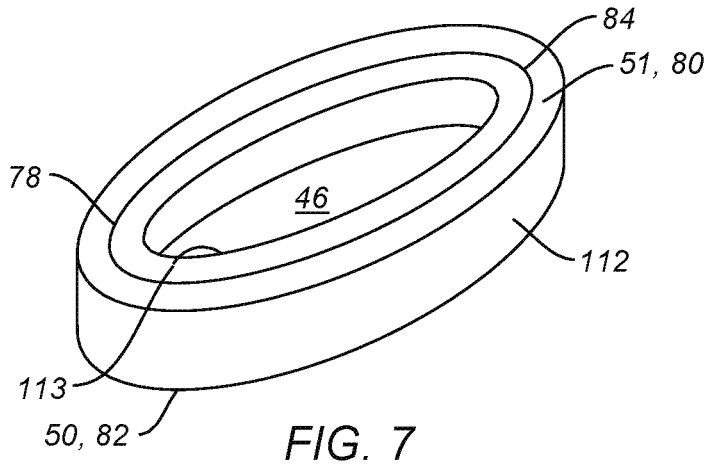
FIG. 7 is a diagrammatic angled view of a cassette embodiment according to the present disclosure.
Figure 8:
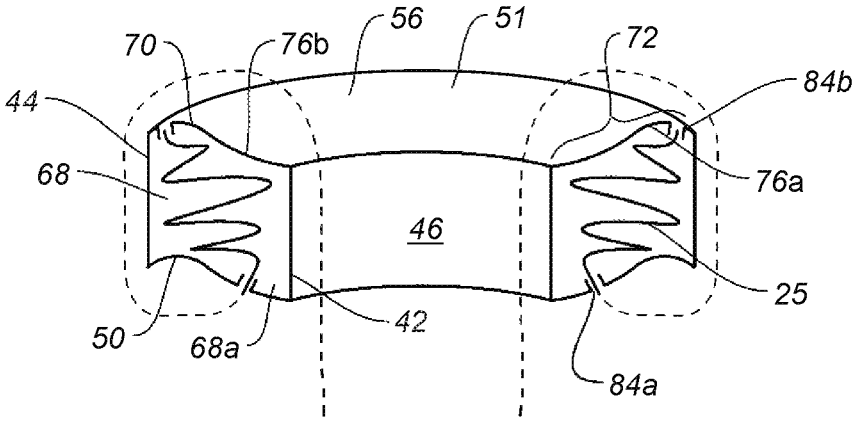
FIG. 8 is a diagrammatic vertical sectional view of a cassette embodiment of the present disclosure.
Figure 9:
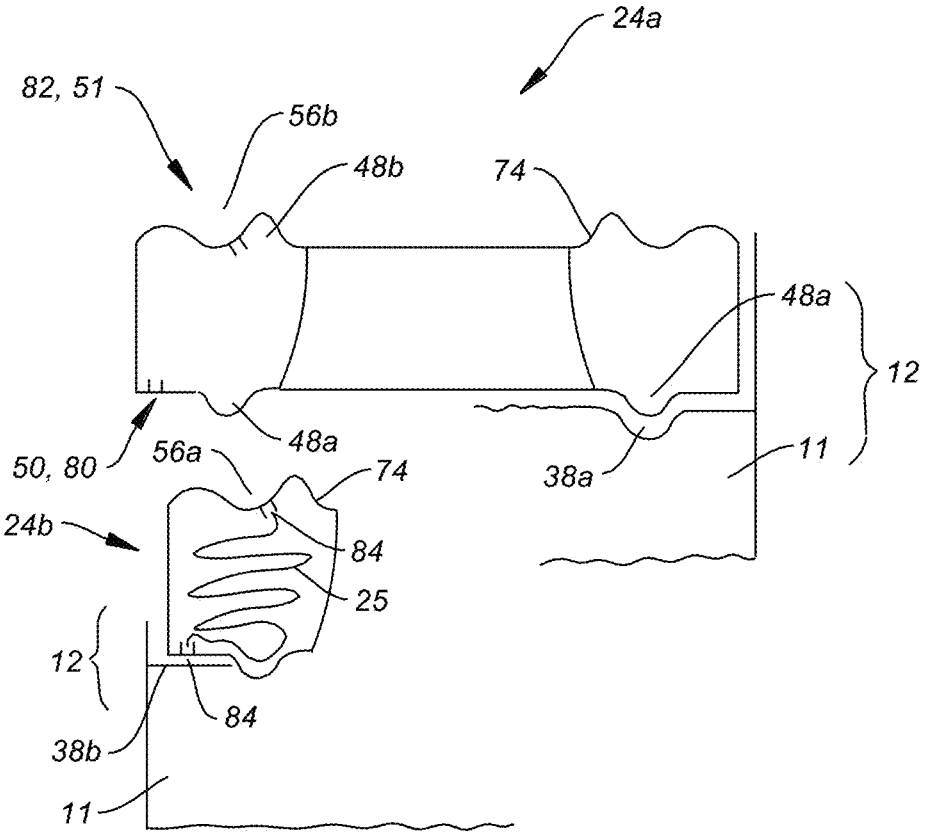
FIG. 9 is a diagrammatic vertical sectional view of a waste disposal system embodiment according to the present disclosure.
Figure 10A:
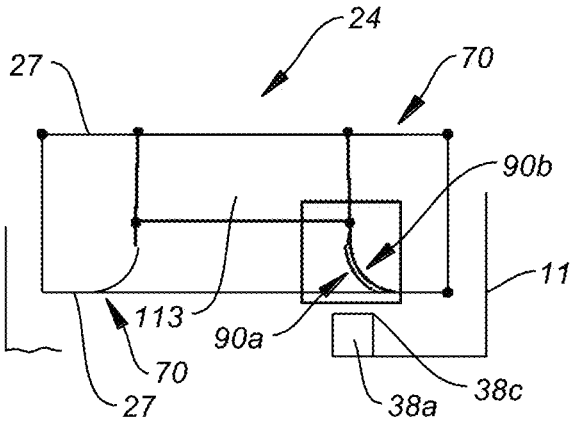
FIG. 10A is a diagrammatic sectional view of a waste disposal system embodiment according to the present disclosure.
Figure 10B:
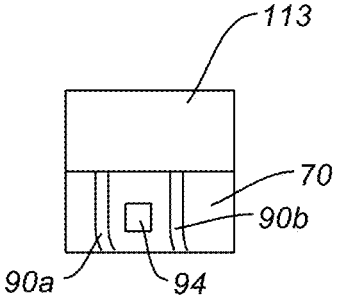
FIG. 10B is a diagrammatic detailed view of a portion of FIG. 10A.

In some embodiments, such as the embodiment shown in FIG. 4C, the guide feature 48 is a pocket 102. The pocket 102 has a recessed portion 104 that matingly engages with a guide member 38. The pocket 102 may have one or more walls 106 thereby containing at least a portion of the guide member 38 within the pocket, thereby connecting the cassette 24 to the waste disposal device 11. The one or more walls 106 of the pocket 102 may have one or more distal ends 108 that are shaped to be or made from a material that is deflectable to promote an interference fit with the guide member 38 and thereby form a further stable connection between the cassette 24 and the waste disposal device 11.

Figure 11:
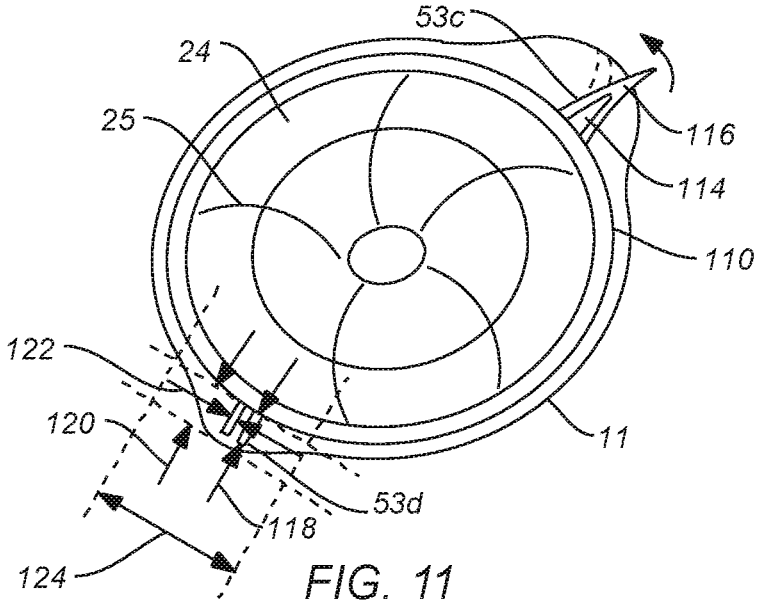
FIG. 11 is a diagrammatic angled view of a waste disposal system embodiment according to the present disclosure.
Figure 12:
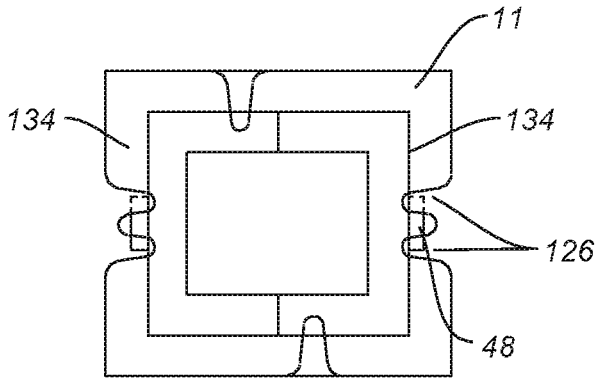
FIG. 12 is a diagrammatic top view of a waste disposal system embodiment according to the present disclosure.
Figure 13:
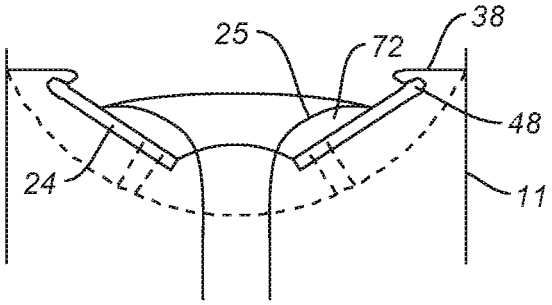
FIG. 13 is a diagrammatic vertical sectional view of a waste disposal system embodiment according to the present disclosure.
Figure 14:
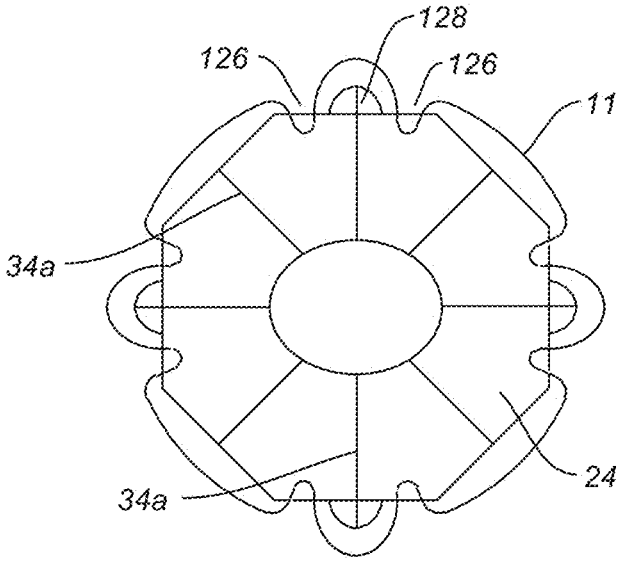
FIG. 14 is a diagrammatic top a waste disposal system embodiment according to the present disclosure.
Figure 15A:
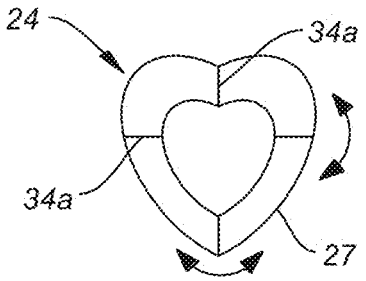
FIG. 15A is a diagrammatic angled view of a cassette embodiment according to the present disclosure.
Figure 15B:
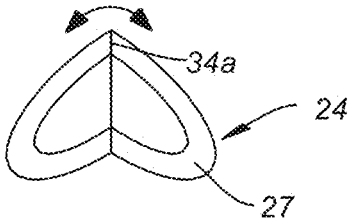
FIG. 15B is a diagrammatic angled view of a cassette embodiment according to the present disclosure.
Figure 16:
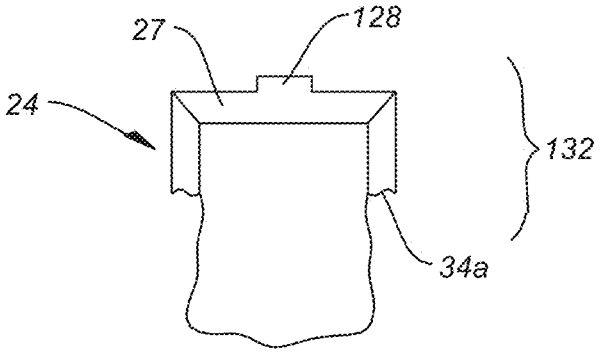
FIG. 16 is a diagrammatic side view of a cassette embodiment according to the present disclosure.
Figure 17:
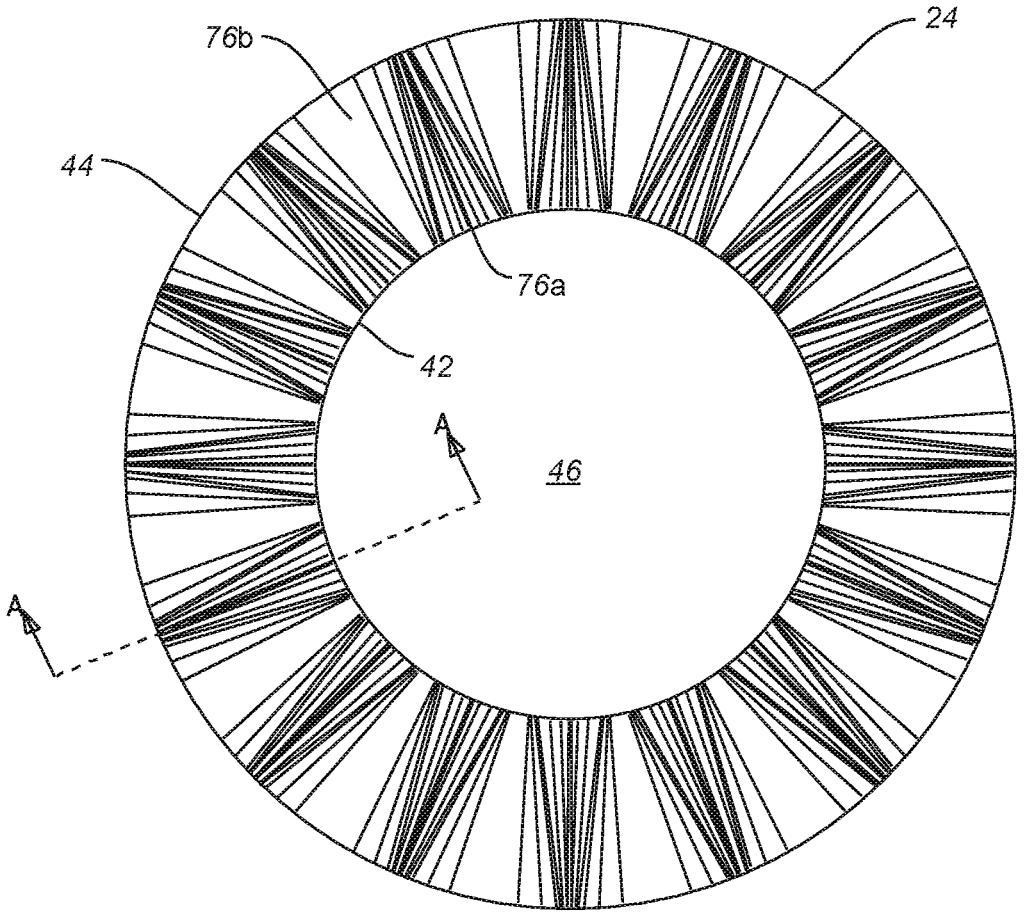
FIG. 17 is a diagrammatic side view of a cassette embodiment according to the present disclosure.
Figure 18A:
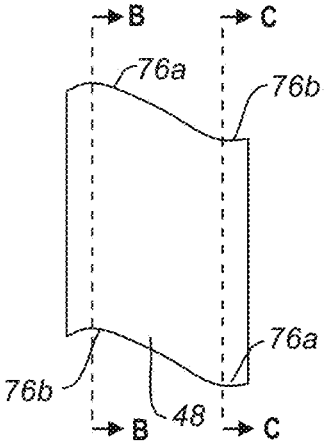
FIG. 18A is a diagrammatic side section view of a cassette embodiment of FIG. 17, about section line A-A, according to the present disclosure.
Figure 18B:
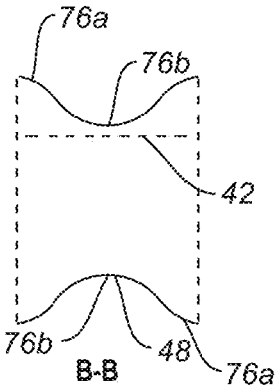
FIG. 18B is a diagrammatic side view of a cassette embodiment of FIG. 18A, about section line B-B, according to the present disclosure.
Figure 18C:
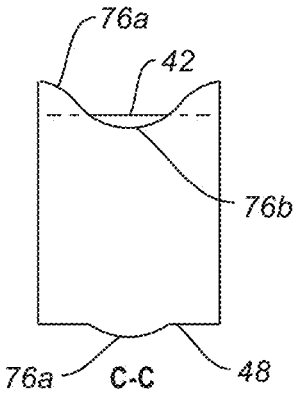
FIG. 18C is a diagrammatic side view of a cassette of FIG. 18A, about section line C-C, according to the present disclosure.
Figure 19:
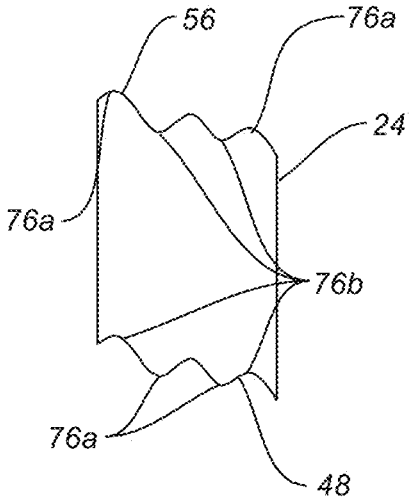
FIG. 19 is a diagrammatic side sectional view of another cassette embodiment of FIG. 17, about section line A-A, according to the present disclosure.

The cassette 24 outer perimeter 44 is defined by an outermost edge 110 of the cassette 24. In some embodiments, the cassette 24 outer perimeter 44 is defined be an outer wall 112. The outer wall 112, in addition to or in alternative to the upper surface 51 or the lower surface 50, has one or more guide features 48. These one or more guide features 48 can extend the entire height of the outer wall 112, or merely extend outward from a portion of the outer wall 112. As shown in FIG. 11, the guide features 48 comprise a single fin 53*c* that has a substantially rigid portion 114. In some embodiments, the single fin 53*c* has a substantially rigid portion 114 proximal to the outer wall 112, outermost edge 110 or perimeter 44 and includes a substantially flexible portion 116 towards the distal end 108 of the fin 53*c*. In embodiments having two such portions, the fin 53*c* can having varying geometry and be of a single material, could be a blend of two or more materials, and/or could be a two-shot part where the overmolded material is more flexible than the first shot material, and the overmolded material has a length greater than the first shot material. In some such embodiments, the fin 53*c* is also thin and/or elongate. The fin 53*d* of this embodiment is advantageous in that it has a greater opportunity to mate with a vast number of guide members 38 that are shaped differently. For instance, a fin 53*d* having a length 118 similar to the depth 120 of the guide member 38 and a width 122 less than the width 124 of the guide member 38, albeit may permit some movement of the fin 53*d* in the guide member 38, but will adequately contain the fin such that the cassette 24 is secured to (i.e. inside) the waste disposal device 11.

In some embodiments, a cassette 24 has an outer diameter that corresponds to outer perimeter 44 and an inner diameter that corresponds to inner perimeter 42, and a length of film 25 attached to the cassette 24 proximal the outer diameter. In other embodiments, the length of film 25 is attached to said cassette 24 proximal the inner diameter]. The film 25 is attached on a first end 80 of the cassette 24. The cassette 24 has at least one guide feature 48 that is received in at least one guide member 38. In some embodiments, the guide member 38 has at least two protrusions 126 that extend outward from the waste disposal device 11 inside the upper housing 14. The two protrusions 126 are shaped to cover at least a portion of the cassette 24 in order to retain the cassette 24 inside the waste disposal device. The cassette 24, in these embodiments, has at least one guide feature 48 that fits between the two protrusions 126. The guide feature 48 is shaped (with respect to the guide members 38) to enable a user to interact with the cassette 24 and the waste disposal device 11 to move the guide member 38 to insert the cassette 24 into the waste disposal device 11 and remove the cassette 24 from the waste disposal device 11. In some embodiments, the cassette 24 is flexible and/or hinged such that guide feature 48 and two protrusions 126 interleave in order to achieve connection and/or removal. In other embodiments, the guide feature 48 has a tab 128 sized such that the user can grip the cassette 24 and remove the cassette 24. In other embodiments, the guide feature 48 is curved and the guide members 38 as sized to enable a user's finger to reach underneath the cassette 24 (about the outer diameter) and remove the cassette 24.

In the aforementioned embodiments having a cassette 24 with film 25 attached to the upper surface 51 of the cassette 24, where it is intended that this is the correct configuration in the waste disposal device 11 (i.e. where the film diameter is less than the outer perimeter 44, to ensure the film 25 touches the waste being deposited and not the cassette 24 itself), the cassette 24 guide features 48 are configured to prevent improper orientation (i.e. film-side down such that the cassette 24 upper surface 50 is exposed to waste). The guide member(s) 38 is(are) suitably shaped to interact with the guide feature(s) 48.

In some embodiments, the cassette 24 first end 80 is distinct from the second end 82, and only one of the first end 80 and the second end 82 have guide feature(s) 48 that matingly engage guide member(s) 38 in the waste disposal device 11.

In some embodiments of a single-use cassette (e.g., 24) the cassette body 27 is flexible such that the inner diameter (e.g., at perimeter 42) is positioned lower in the upper housing than the outer diameter 44, thereby forming a sloped shape or funnel-like shape 72. The cassette body 27 can be collapsible in order to seal the film 25 after the film 25 is filled with waste. The cassette body 27 is like a spring such that cassette body 27 urges itself into a closed position 132 upon moving the outer edges 134 upward and towards each other. Alternatively or similarly, the cassette body 27 is spring-like and upon moving the outer edges 134 outward and away from each other, they "snap" into place (e.g., such that the guide features 48 mate with the guide members 38 and position the cassette 24 within the waste disposal device 11). In such embodiments, the cassette body 27 is a resilient material (or combination of materials), that is capable of being substantially rigid (i.e. when the cassette 24 is retained in the waste disposal device 11) and substantially flexible (i.e. when the cassette 24 is being inserted and/or being removed and put into a closed position 132). As such, the cassette body 27 can be a two-shot part where the first shot is a more rigid material (e.g., LDPE, HDPE, ABS, etc. . . . ) and the second shot is a more flexible material (e.g., thermoplastic elastomer (TPE)). A spring-like material and/or living hinge (e.g., 34*a*) can be incorporated into the cassette body 27 to assist with the aforementioned functionality.

In other embodiments, two or more fins (e.g., 53*d*) may be used. In these embodiments, the two fins 53*d* may be separated from each other but proximal such that two fins 53*d* can interact with a single guide member 38. As stated above, this configuration may permit some movement of the two fins 53*d* within the guide member 38, but will adequately contain the two fins 53*d* such that the cassette 24 is secured to the waste disposal device 11.

The cassette body can be a variety of cross-sectional shapes and configurations, including arcuate, polygonal, etc . . . .

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the scope thereof. Therefore, it is intended that the present disclosure not be limited to the particular embodiment(s) disclosed as the best mode contemplated, but that the disclosure will include all embodiments falling within the scope of the present disclosure.

What is claimed is:

1. A cassette for the collection and storage of waste, the cassette comprising:

a length of film, said length of film defining an interior volume for the collection and storage of waste, the length of film having a first end and a second end;

a cassette body comprising an inner perimeter, said inner perimeter defines an opening area sized to receive waste, the cassette body having a lower surface portion and a wall in said lower surface portion, said cassette body defines a hollow volume for the storage of said length of film, wherein said length of film is in a pleated or folded configuration within said hollow volume;

a guide feature at a bottom of the cassette body configured to engage a guide member in a cassette receiving portion of a waste disposal device, the guide feature defined by the wall of the cassette body having an undulated shape extending circumferentially about a full revolution of the opening area in said lower surface portion, the undulated shape defining an alternating sequence of peaks and valleys along the full revolution of the opening area, the peaks sloped toward the inner perimeter;

wherein the peaks have a widthwise dimension taken along a circumference of the cassette, wherein the widthwise dimension about the inner perimeter of the cassette body is smaller than about an outer perimeter of the cassette body, wherein the peaks have a heightwise dimension about the inner perimeter smaller than about the outer perimeter of the cassette body, and wherein a widthwise and heightwise variance in the peaks and the valleys approach each other up to the inner perimeter; and wherein said cassette body has an opening defined between the inner perimeter and the outer perimeter on an upper portion of said cassette body, the upper portion opposite to the bottom of the cassette body, the opening permitting dispensation of said length of film upwardly out of said hollow volume and downwardly through said opening area.

2. The cassette according to claim 1, wherein said guide feature reduces said hollow volume.

3. The cassette according to claim 1, wherein said wall of the cassette is rigid.

4. The cassette according to claim 1, wherein the undulated shape of the guide feature is free of plateaued surfaces.

5. The cassette according to claim 1, wherein the valleys are sloped towards the inner perimeter.

6. The cassette according to claim 1, wherein the guide feature is a cassette orienting feature for preventing an improper upside down orientation of the cassette within the cassette receiving portion of a waste disposal device, the lower surface portion of the cassette body defines a first end of the cassette, the cassette having a second end opposite the first end, the second end having a shape distinct from that of the lower surface portion having the guide feature.

7. The cassette according to claim 1, wherein the film is a tubular film having a diameter smaller than the outer perimeter of the cassette body.

8. A cassette for the collection and storage of waste, the cassette comprising:

a length of film, said length of film defining an interior volume for the collection and storage of waste, the length of film having a first end and a second end;

a cassette body comprising an inner perimeter, said inner perimeter defines an opening area sized to receive waste, the cassette body having a lower surface portion, said cassette body defines a hollow volume for the storage of said length of film, wherein said length of film is in a pleated or folded configuration within said hollow volume; and a guide feature defined by a wall having an undulated shape extending circumferentially about a full revolution of the opening area in said lower surface portion, the undulated shape defining an alternating sequence of peaks and valleys along the full revolution of the opening area, the peaks and the valleys are sloped toward the inner perimeter.

9. The cassette according to claim 8, wherein the undulated shape of the guide feature is free of plateaued surfaces.

10. The cassette according to claim 8, wherein said guide feature reduces said hollow volume.

11. The cassette according to claim 8, wherein said wall of the cassette is rigid.

12. The cassette according to claim 8, wherein the guide feature is a cassette orienting feature for preventing an improper upside down orientation of the cassette within a cassette receiving portion of a waste disposal device, the lower surface portion of the cassette body defines a first end of the cassette, the cassette having a second end opposite the first end, the second end having a shape distinct from that of the lower surface portion having the guide feature.

* * * * *